United States Patent [19]

Mourier

[11] Patent Number: 4,567,402

[45] Date of Patent: Jan. 28, 1986

[54] ELECTRON BEAM INJECTION DEVICE FOR AN ULTRA-HIGH FREQUENCY RADIO ELECTRIC WAVE GENERATOR

[75] Inventor: Georges Mourier, Le Port Marly, France

[73] Assignee: Thomson-CSF, Paris, France

[21] Appl. No.: 595,663

[22] Filed: Apr. 2, 1984

[30] Foreign Application Priority Data

Apr. 6, 1983 [FR] France ..... 83 05604

[51] Int. Cl.[4] ..... H01J 25/34

[52] U.S. Cl. ..... 315/39.3; 315/5.34; 315/5.35; 315/39.51

[58] Field of Search ..... 315/5.35, 39.3, 5.34, 315/5.37

[56] References Cited

U.S. PATENT DOCUMENTS

| | | | |
|---|---|---|---|
| 2,632,130 | 3/1953 | Hull | 315/3.6 |
| 2,970,241 | 1/1961 | Klein | 315/39.3 |
| 3,175,119 | 3/1965 | Belohoubek | 315/5.34 |
| 3,325,677 | 6/1967 | Orr | 315/39.3 |
| 3,417,280 | 12/1968 | Kantorowicz | 315/39.3 |
| 3,619,709 | 11/1971 | Dudley | 315/39.3 |
| 4,021,697 | 5/1977 | Doehler | 315/39.3 |

FOREIGN PATENT DOCUMENTS 1342263 9/1963 France .
1049409 11/1966 United Kingdom .

OTHER PUBLICATIONS

"Power Traveling Wave Tubes" by Gittins published 196, pp. 113, 153–155, 170–172.

IEEE Transactions on Electron Devices, vol. ED-17, No. 10, Oct. 1970, pp. 935–938 New York (U.S.); G. S. Sidhu et al.: "The Experimental Characteristics of a Wide Dynamic Range Crossed-Field Gun" FIG. 1.

*Primary Examiner*—Harold Dixon

*Attorney, Agent, or Firm*—Roland Plottel

[57] ABSTRACT

A device is provided for injecting an electron beam propagating along an axis (x) in a cycloidal path under the action of a continuous electric field and a static magnetic field (B) perpendicular to the axis of propagation and to the electric field. The injection device comprises an electron gun placed in a weak magnetic field ($B_1$) and means, placed in a magnetic field ($B_2$) increasing progressively along the axis (x), for creating in this zone a continuous electric field having two components in the plane perpendicular to the magnetic field.

3 Claims, 4 Drawing Figures

FIG_1-a
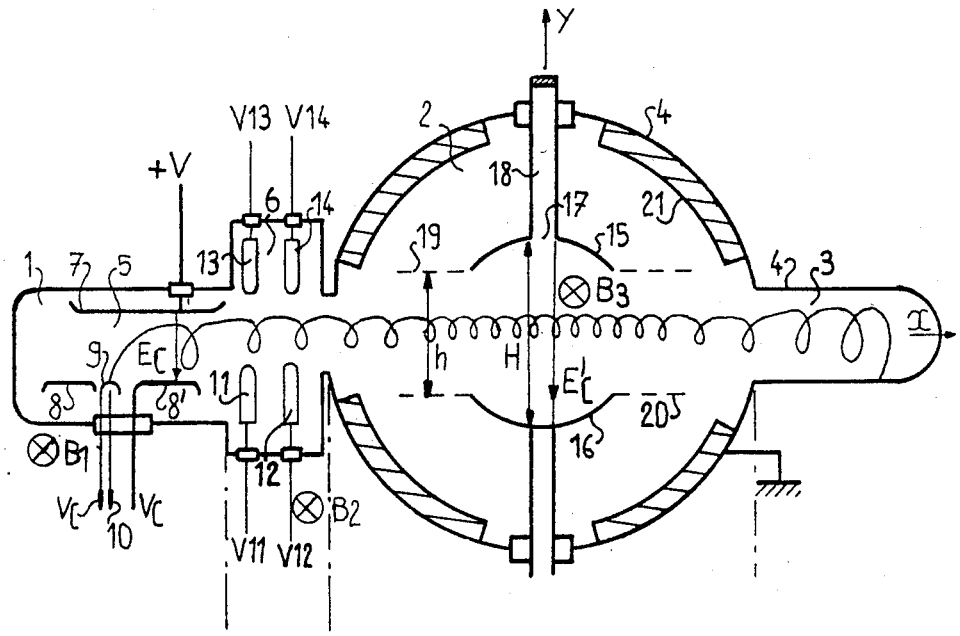
FIG_1-b
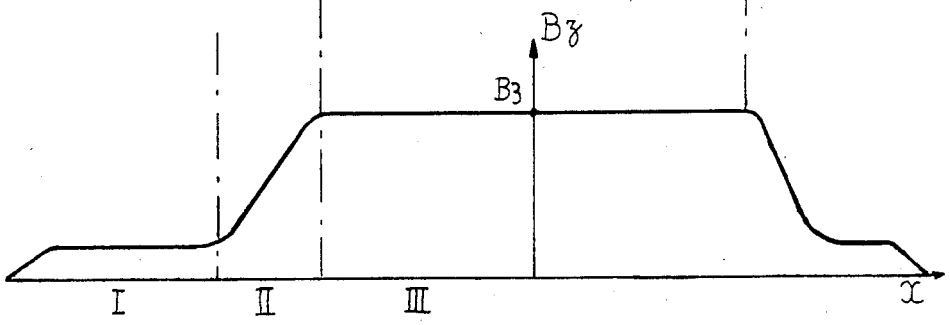

FIG_2-a
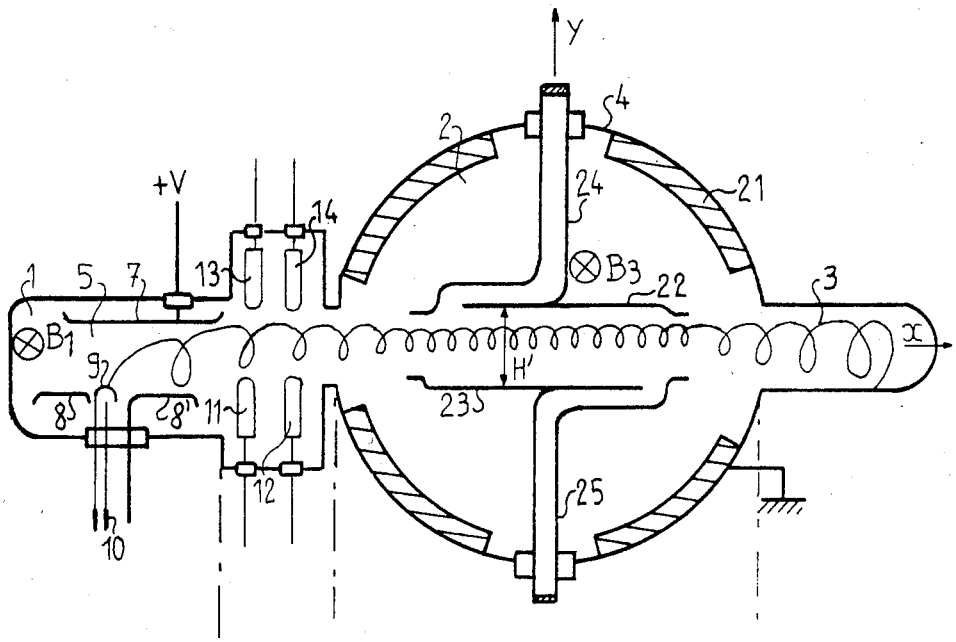
FIG_2-b
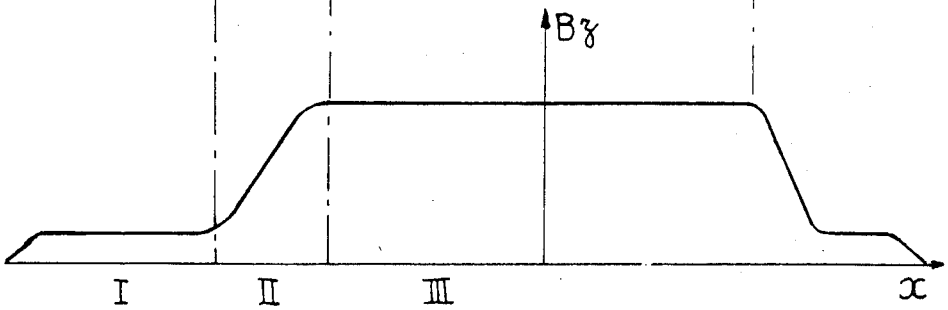

ELECTRON BEAM INJECTION DEVICE FOR AN ULTRA-HIGH FREQUENCY RADIO ELECTRIC WAVE GENERATOR

BACKGROUND OF THE INVENTION

1. Field of the Invention

The present invention relates to an electron beam injection device for radio electric wave generators for ultra-high frequencies. It relates more particularly to a device for injecting an electron beam propagating along an axis in a cycloidal path under the action of a continuous electric field and subjected to a static magnetic field perpendicular to the axis and to the electric field.

2. Description of the Prior Art

This type of injection device may be used, in particular, in the new cyclotronic resonance masers proposed by the applicant in the new patent application filed on the same day as the present one and entitled "Radio electric wave generator for ultra high frequencies". In these generators based on an interaction of the cyclotronic type between an electron beam propagating between an electron gun and a collector and a high frequency electro magnetic field in a resonating structure, in which generator the electron beam moves along a cycloidal path in a transverse magnetic field under the effect of a deflection velocity created by a DC electric field, the injection device is formed solely by an electron gun subjected to a high magnetic field, identical to the one reigning in the resonating structure.

The electron gun used in this generator is formed by two facing electrodes one of which, the anode, is brought to a positive potential and the other, the sole, is brought to a negative or zero potential and a cathode positioned in the plane of the sole and brought to the same potential as this latter, at least one of the electrodes having a divergent profile such that the distance between electrodes increases from the cathode to the outside. With this type of electron gun, so as to obtain an electron beam propagating along a cycloidal path with a substantially constant radius of rotation $r_L$, the voltage to be applied to the anode must be substantially higher than the supply voltage providing the energy of the electron beam.

SUMMARY OF THE INVENTION

The aim of the present invention is to remedy this disadvantage by proposing a new type of injection device.

It further allows a magnetic field to be used in the gun smaller than in the resonating structure.

The injection device of the invention is a device for injecting an electron beam along a cycloidal path for radio electric wave generators for ultra high frequencies using an electron beam propagating along an axis under the action of a continuous electric field and subjected to a static magnetic field perpendicular to the axis of propagation and to the electric field, as well as to the electromagnetic field of at least one resonating structure disposed along the axis. This device comprises an electron gun placed in a weak magnetic field and means placed in a progressively increasing magnetic field for creating between the electron gun and the resonating structure placed in a strong magnetic field, a continuous electric field having two components in a plane perpendicular to the magnetic field.

BRIEF DESCRIPTION OF THE DRAWINGS

Other features and advantages of the present invention will be clear from reading the description of two embodiments of radioelectric wave generators for ultra-high frequencies having an injection device in accordance with the invention.

This description is made with reference to the accompanying drawings in which:

FIG. 1*a* is a view in schematical section, in a plane perpendicular to the magnetic field, of an ultra-high frequency radio electric wave generator comprising an injection device in accordance with the present invention and FIG. 1*b* is a curve showing the variation of the applied magnetic field, along the axis of propagation;

FIG. 2*a* is a view similar to that of FIG. 1*a* of another embodiment of the generator and FIG. 2*b* is a curve similar to that of FIG. 1*b*.

In the drawings, the same elements bear the same references.

DESCRIPTION OF THE PREFERRED EMBODIMENTS

The generator shown in FIG. 1*a* comprises essentially three parts, namely an injection device 1, a resonating structure 2 and a collector 3, the whole being placed in a vacuum enclosure 4 brought to a zero potential. In accordance with the present invention, the injection device 1 is formed by an electron gun 5 producing an electron beam in direction x followed by means 6 for creating an electric field E without any component in the direction z but having two components $E_x$ and $E_y$ in the plane of the figure. The injection device 1 is placed in a static magnetic field perpendicular to the plane of the figure, i.e. with direction z. The magnetic field applied in the present invention is such that the electron gun 5 is subjected to a low value magnetic field $B_1$ and means 6 to a magnetic field $B_2$ increasing progressively from the value $B_1$ to the value $B_3$ representing the magnetic field at the level of the resonating structure 2, as shown respectively by the parts I, II, III in FIG. 1*b*. More precisely, the electron gun 5 is formed by two flat electrodes 7, 8 facing each other, one of which 7 called anode is brought to a positive potential V and the other called sole is formed of two parts 8, 8' and is brought to a negative potential $V_c$ and a cathode 9 heated by a filament 10 and brought to the same potential $V_c$ as the sole 8. This type of electron gun provides in a way known per se an electron beam following, in direction x, a cycloidal path. In the embodiment shown, the means 6 are formed by four electrodes 11, 12, 13 14 brought to DC potentials such that, for example, $$V_c<V_{11}<V_{12}<V_{13}<V_{14}<0$$

In this part, as explained in greater detail hereinafter, the electrons present in an electric field having two components $E_x$ and $E_y$ and subjected to a uniformly increasing static magnetic field of direction z, are caused to follow a cycloidal path whose radius of rotation decreases progressively as shown in FIG. 1*a*.

The electron beam is then injected into the resonating structure 2 in which it interacts with a high frequency electro magnetic field. At the level of the resonating structure 2, enclosure 4 has the form of a cylinder with axis z inside which the static magnetic field $B_3$ is practically uniform. The resonating structure 2 is formed, in a way known per se, by two spherical mirrors 15, 16 facing each other and positioned so that the distance H confirms the relationship:

$$H \simeq n(\lambda/2)$$

with n a whole number and λ the operating wave length.

In this case, the two mirrors 15, 16 form a "quasioptical" resonator. One of the mirrors, namely mirror 15, is provided with an orifice 17 connected to a wave guide 18. This wave guide 18 is used for feeding to the outside the electromagnetic energy given up by the electron beam to the electromagnetic wave which appears as a standing wave in direction y with a high frequency electric field polarized in direction x. To ensure propagation of the electron beam along direction x in the cylindrical part of envelope 4, the two mirrors 15, 16 are preceded and followed by grids 19, 20 which are non reflecting at the operating frequency of the resonator and are spaced apart by a distance h such that $$h < H$$

Furthermore, the two mirrors 15 and 16 are tied respectively to ground and to a negative potential so as to create therebetween a continuous electric field Ec of direction y which ensures the deflection of the electron beam along direction x.

The cylindrical part of envelope 4 is preferably covered with substances 21 which are absorbent at the operating frequencies so as to avoid parasite resonances. These substances are, for example, formed from "carberlox" (trademark).

The electrons which have given up their energy are then removed towards a collector 3 formed by a part of envelope 4 having a cross sectional shape in the plane xy in the form of a U.

FIG. 2*a* shows a modification of the generator of FIG. 1*a* which then forms an amplifier. In this embodiment, only the resonating structure has been modified, the other parts remaining identical.

The new structure is formed of two flat parallel plates 22, 23 spaced apart from each other by distance H′ such that $H' \simeq n(\lambda/2)$, so as to guide, in direction x, a high frequency travelling wave having at least one high frequency electric field component in the plane xy. The travelling wave is injected into the structure through the input wave guide 24 and it is removed, after receiving the energy given up by the electron beam, through the output wave guide 25. On the other hand, so as to obtain deflection of the electron beam in direction x, the two plates are polarized so as to create therebetween a continuous electric field of direction y.

It should further be mentioned that all the elements shown in section in the plane xy are very much extended in direction z. This feature of generators of this type forms an advantage with respect to the axial structures of the gyrotron type. In fact, the dimension of the different elements in direction z may correspond to a large number of wave lengths, which allows a very high current to be obtained, for a given cathode voltage, with limited current density and power density at the collector.

In so far as FIG. 2*b* is concerned, it is identical to FIG. 1*b* and gives the variation of the static magnetic field B in direction x. The magnetic field is created in a way known per se by means of super conducting coils, for example.

The operation of the two embodiments shown in FIGS. 1*a* and 2*a* will now be explained, in particular the operation of the injection device forming the subject of the present invention.

The operation of the injection device is based on known principles which will be recalled briefly hereafter.

Thus, when an electron is subjected to a slowly varying axially magnetic field, it can be shown that the path winds around tubes of force and we have so called "adiabatic" operating conditions for which:

$$Br_L^2 = cste \tag{1}$$

$R_L^2$ being the gyration radius of the beam.

It can also be shown that a similar property exists in the case of transverse injection in a non uniform magnetic field.

Thus, in the plane xy, the component $B_z$ is a function of x and y, theoretically only of $R=\sqrt{x^2+y^2}$. However, it can be demonstrated that, for a system of large dimensions with respect to the orbit radius of the electrons, equation (1) remains valid.

On the other hand, in the plane xy, the center of the orbit of the electrons of coordinates X(t), Y(t) moves in accordance with the equations $$\frac{dX}{dt} = \frac{E_y}{B} - \left(\frac{qB}{m}\ \frac{r_L^2}{2}\right)\frac{1}{B}\ \frac{\partial B}{\partial x} \tag{2}$$

$$\frac{dY}{dt} = -\frac{Ex}{B} + \left(\frac{qB}{m}\ \frac{r_L^2}{2}\right)\frac{1}{B}\ \frac{\partial B}{\partial x} \tag{3}$$

with B corresponding to $B_z$.

In the injection device 1 of the present invention the electron gun 5 placed in a weak magnetic field region $B_1$, produces an electron beam progressing towards the central region of said field, where it is maximum, while moving perpendicularly to its direction. The progression along a cycloidal path is ensured by the electrodes placed in the vicinity of its path and brought to appropriate potentials, which creates between the electrodes a uniform continuous electric field giving to the electrons a deflection velocity.

The electron beam is then subjected, in the region of means 6, to a progressively increasing magnetic field of direction $B_z$. Furthermore, the different potentials of electrodes 11, 12 13, 14 have been chosen so as to create an electric field having components in directions x and y and so as to satisfy the following equations.

$$\frac{\partial B}{\partial y} = 0 \quad \frac{dX}{dt} = \frac{Ey}{B} \tag{4}$$

$$\frac{dY}{dt} = 0 \quad Ex = \left(\frac{qB}{m}\ \frac{r_L^2}{2}\right)\frac{\partial B}{\partial x} \tag{5}$$

with $(Ey/B)>0$ so that the electron beam propagates in direction x.

In this case, the electron beam will, in the zone of the increasing magnetic field, be caused to follow a cycloidal path whose radius decreases progressively because of equation (1) in direction x with a constant deflection velocity if component $E_y$ increases like $B_z$ whose variation along x is given in FIGS. 1*b* and 2*b*. In fact, the condition given by equation (5) avoids a transverse deflection and allows the electrons to enter the increasing magnetic field which normally tends to repel the electrons endowed with a rotational speed towards the regions where B is smaller, namely towards the gun.

With the above injection device, there is then obtained, at the input of the resonating structure, an electron beam moving along a helical path in direction x in a strong transverse magnetic field so that the rotational speed of the electrons is equal to $$\omega_c = \frac{e}{mo} \frac{B}{\gamma}$$

with e=charge of the electron mo=mass at rest of the electron $\gamma$=reduced relativistic energy of the electron $$= \frac{1}{\sqrt{1 - v^2/c^2}}$$

so as to be able to obtain the desired interaction in the resonating structure 2.

With this injection device, the following advantages are obtained:

possibility of producing an electron beam with large section along z giving higher current and power;

absence of electrons reflected towards the gun;

deflection velocity of the electrons adjusted solely by the voltage applied to the different plates.

What is claimed is:

1. A device for injecting into an interaction zone an electron beam propagating along an axis (x) in a helical path under the action of a continuous electric field and a static magnetic field (B) perpendicular to the axis of a propagation and to the electric field, comprising an electron gun placed in a weak magnetic field and means, placed in a magnetic field ($B_2$) increasing progressively along the axis of propagation of the beam, for creating in this zone a continuous electric field having two components ($E_X$, $E_Y$) in the plane perpendicular to the magnetic field to compensate the movement perpendicular to the axis due to the increasing of the magnetic field, said means being located between the gun and the interaction zone.

2. A device for injecting an electron beam propagating along an axis (x) in a helical path under the action of a continuous electric field and a static magnetic field (B) perpendicular to the axis of propagation and to the electric field, comprising an electron gun placed in a weak magnetic field and means, placed in a magnetic field ($B_2$) increasing progressively along the axis of propagation of the beam, for creating in this zone a continuous electric field having two components ($E_X$, $E_Y$) in the plane perpendicular to the magnetic field, wherein said means are formed by at least four electrodes facing each other in twos and brought to potentials chosen so that the equations $$\frac{\partial B}{\partial Y} = 0 \quad \frac{dX}{dt} = \frac{E_Y}{B}$$

$$\frac{dY}{dt} = 0 \quad Ex = \left( \frac{qB}{m} \frac{r_L^2}{2} \right) \frac{\partial B}{\partial x}$$

with (Ey/B)>0 are satisfied.

3. An injection device as claimed in claim 2, wherein the variation of component $E_y$ is chosen so that (Ey/B)=cste in the increasing magnetic field zone.

* * * * *